United States Patent [19]

Yamamura et al.

[11] Patent Number: 4,908,988

[45] Date of Patent: Mar. 20, 1990

[54] SELF-DRIVING CLOSURE DEVICE

[75] Inventors: Kengo Yamamura, Inasa; Tutomu Saito, Toyohashi; Youji Higuchi, Okazaki; Yasuhiro Fukatsu, Hamamatsu; Takahiro Yamada, Kosai; Katsuhiko Torii, Hamana, all of Japan

[73] Assignees: Asmo Co., Ltd., Shizuoka; Nippon Denso Co., Ltd., Aichi, both of Japan

[21] Appl. No.: 341,228

[22] Filed: Apr. 21, 1989

[30] Foreign Application Priority Data

Apr. 25, 1988 [JP] Japan ..... 63-103402
Apr. 25, 1988 [JP] Japan ..... 63-103400

[51] Int. Cl.[4] ..... E05F 15/16

[52] U.S. Cl. ..... 49/358; 49/349; 49/352

[58] Field of Search ..... 49/358, 349, 352, 374

[56] References Cited

U.S. PATENT DOCUMENTS 3,775,906 12/1973 Dougherty ..... 49/358
3,785,089 1/1974 Smith ..... 49/358 X
4,167,833 9/1979 Farina et al. ..... 49/358 X
4,167,834 9/1979 Pickles ..... 49/358
4,170,847 10/1979 Pickles ..... 49/358 X
4,353,185 10/1982 Saigne ..... 49/349 X
4,389,818 6/1983 Sakamoto ..... 49/349

FOREIGN PATENT DOCUMENTS 60-68284 5/1985 Japan .
61-286485 12/1986 Japan .

*Primary Examiner*—Philip C. Kannan
*Attorney, Agent, or Firm*—Oliff & Berridge

[57] ABSTRACT

A self-driving closure device for moving a closure member such as a window glass of a vehicle between an open position and a close position. The device has a motor movable together with the closure member. The motor has a pinion that meshes with a rack secured to the vehicle door or a rotary drum on which an intermediate portion of a wire secured to the door is wound, so that a thrusting force for driving the window glass between the open and close positions is generated as a reactional force as the pinion or the drum is rotated. A mechanism is provided between the motor and the window glass so as to absorb any offset between the direction of movement of the glass and the direction of movement of the motor, so as to ensure smooth movement of the window glass.

20 Claims, 21 Drawing Sheets

(A)

SELF-DRIVING CLOSURE DEVICE

BACKGROUND OF THE INVENTION

1. Field of the Invention

The present invention relates to a self-driving closure device for driving a closure member, such as a window glass of a automobile or a sun-roof panel, in order to open and close the window or the roof opening. More particularly, it relates to a self-driving closure device in which the driving power source is carried by the closure member so as to move as a unit therewith.

2. Description of the Prior Art

A self-driving power window regulator, which has become popular in recent years, for use on, for example, passenger cars, will be described as an example of the conventional self-driving closure device.

Such self-driving power windows are disclosed, for example, in Japanese Utility Model Laid Open Publication No. 60-68284 and Japanese Patent Laid-Open No. 61-286485. The self-driving power windows shown in Japanese Utility Model Laid-Open Publication No. 60-68284 will be described by way of example.

As shown in FIG. 24, the power window regulator shown in the above-mentioned Utility Model has a glass holder 12 fixed to the lower end of the window glass 10, a reversible motor 14 fixed to the glass holder 12, a pinion gear 18 which is driven by the motor 14 through a worm gear 16, and a rack 20 which is fixed to an inner panel of a door so as to extend vertically and mesh with the pinion 18.

This power window regulator is advantageous in that the number of parts employed is reduced by virtue of the fact that the window glass is driven by the engagement between the stationary rack 20 and the pinion 18 which is carried by the window glass itself.

In the self-driving power window regulator described above, the motor 14, as the driving power source for opening and closing the power window, moves together with the window glass 10 which is the closure member to be driven.

Usually, the path of movement of the window glass 10 is determined by guides which are disposed inside the outer door panel. On the other hand, the motor 14 is required to move in such a manner that the pinion 18 is always maintained in meshing engagement with the rack 20. It is therefore necessary that the motor 14 is moved along the rack 20.

In general, however, a play more or less exists between the window glass 10 and the door guide. It is quite difficult to obtain a high degree of conformity between the paths of the window glass 10 and the pinion because of errors such as those incurred during the mounting of the guides which determine the path of movement of the window glass and the rack 20, dimensional error that is incurred during the fabrication of these parts, and so forth.

In the event that one or both of these paths have been offset from the correct position, the pinion and the rack cannot correctly mesh with each other resulting in impaired smooth driving. In addition, load on the pinion and the rack, as well as the load acting on a rubber cushion of the window, is increased undesirably.

In order to obtain a self-driving power window regulator of the type described, it is necessary to enhance the dimensional precision of the parts, as well as the precision of mounting the rack 20. In consequence, cost is increased and the assembly work is extremely complicated. For these reasons, a self-driving power window regulator of the type described cannot be satisfactorily put into practical use.

SUMMARY OF THE INVENTION

Accordingly, an object of the present invention is to provide a self-driving closure device which is capable of smoothly driving a closure member without the accompanying requirement for excessively high precision while facilitating the assembly. The above-described problems of the prior art are thereby overcome.

To this end, according to the present invention, there is provided a closure device mounted on a stationary part such as a door of a vehicle and capable of driving a closure member such as a window glass, the device comprising: (a) a guide member provided on the stationary part and capable of guiding the closure member moving between an open position and a close position; (b) driving force bearing means extending in the direction of movement of the closure member; (c) a power source movable together with the closure member and capable of generating a driving force and causing the driving force bearing means to bear the driving force and thereby driving the closure member by the reactional force; and (d) relative movement means for allowing the power source and the closure member to move relative to each other in a direction which crosses the direction of movement of the closure member between the open and close positions, thereby absorbing any offset between the direction of movement of the closure member between the open and close positions and the direction of movement of the power source so as to ensure that the driving fore is securely borne by the driving force bearing means.

In operation, the reactional torque produced as a result of operation of the motor is transmitted to the driving force bearing means, so that the closure member is driven between the open and close positions by the power of the motor. The direction of movement of the closure member is determined by guide members, while the direction of movement of the motor is determined by the driving force bearing means. In the event of any offset of the guide member and/or the driving force bearing means from the correct positions has been caused due to reasons such as a dimensional error or an assembly error, or where a play exists between the closure member and the guide member, such offset, or the play, is effectively absorbed by the relative movement means so as to allow the closure member to be moved smoothly.

The pat of movment of the closure member is often curved, particularly in the cases of a power window regulator. In such cases, the offset of the path of movement may take place also in the direction of thickness of the closure member. In addition, a difference may be caused between the curvature of the rack and the curvature of the guide due to, for example, a dimensional error. It is possible to stably maintain the pinion and the rack in a meshing condition so as to ensure the smooth driving of the closure member regardless of any offset of paths of movements of the closure member and the motor. This is accomplished, by allowing a relative rotation between the motor and the closure member both in the direction of thickness of the closure member and the plane which includes the longitudinal axis of he rail.

BRIEF DESCRIPTION OF THE DRAWINGS

FIG. 9 is a sectinal view taken along the line XIX—XIX of FIG. 18;

DESCRIPTION OF THE PREFERRED EMBODIMENTS

Preferred embodiments of the self-driving closure device of the present invention, applied to self-driving power window regulators of automobiles, will be described in detail with reference to the accompanying drawings.

Figure 1:
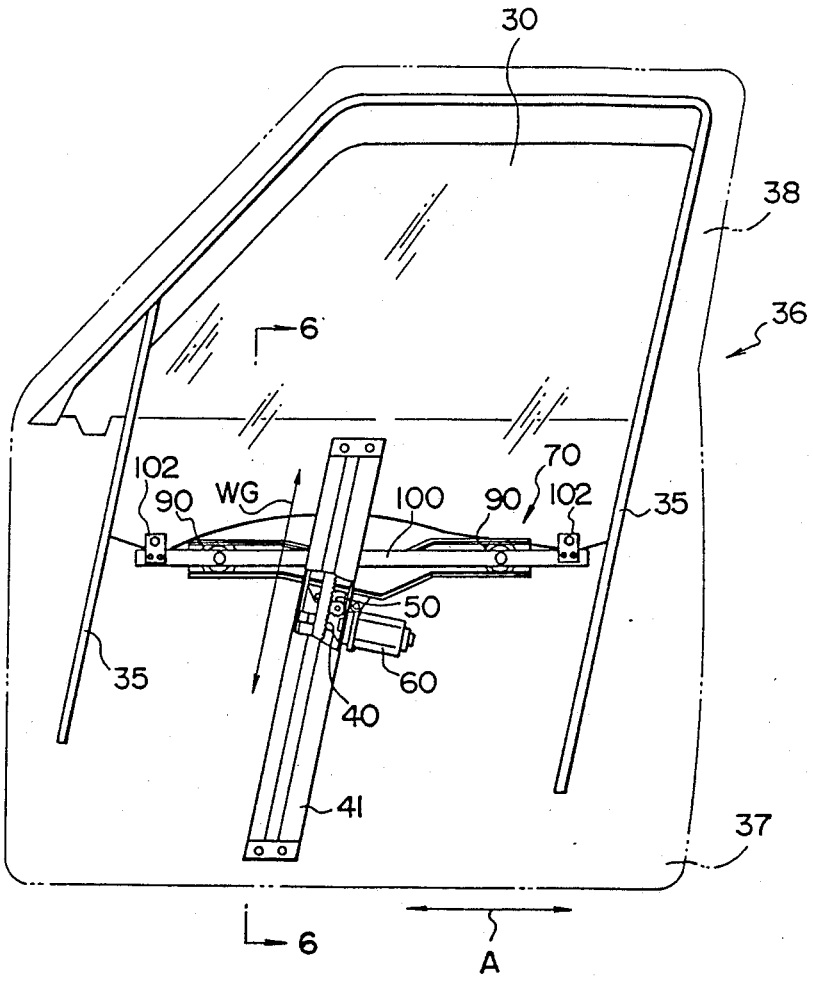
FIG. 1 is a partly cut-away side elevational view of a door of an automobile to which a first embodiment of the present invention is applied, as viewed from the interior of the passenger compartment of the automobile.

FIG. 1 shows a door 36 of a vehicle, to which the self-driving closure device of the present invention is applied. As can be seen from FIG. 6, the door 30 has an inner panel 32 and an outer panel 37 which are bonded together at their peripheral edges so as to form a substantially bux-type structure in which a window glass 30 is movably disposed. As shown in FIG. 1, a gate-like sash 38 protrudes upright from the upper end of the inner panel 32 and the outer panel 37. These sashes 38 cooperate with guides 35 mounted in the door structure so as to provide guides for guiding both breadthwise ends of the window glass 30, i.e., the front and rear ends of the window glass 30 as, viewed in the direction of the running of the automobile, when the window glass is moved up and down.

The window glass 30 is moved up and down together with a motor 60. More specifically, a pinion 50 driven by the motor 60 meshes with a rack 40 which is disposed in the door structure so that a vertical thrust is generated as the pinion 50 is driven by the motor 60. In a strict sense, the window glass moves in a direction which is not exactly vertical but slightly inclined with respect to the vertical direction as indicated by an arrow WG.

The window glass 30 and the motor 60 are connected to each other through a slide supporting mechanism 70 which includes, as its major parts, rollers 90 and a rail 80. The slide supporting mechanism 70 allows the motor 60 to move relative to the window glass 30 in the breathwise direction of the window glass 30, i.e., in the longitudinal direction of the vehicle indicated by a double-headed arrow A in FIG. 1.

Figure 6:
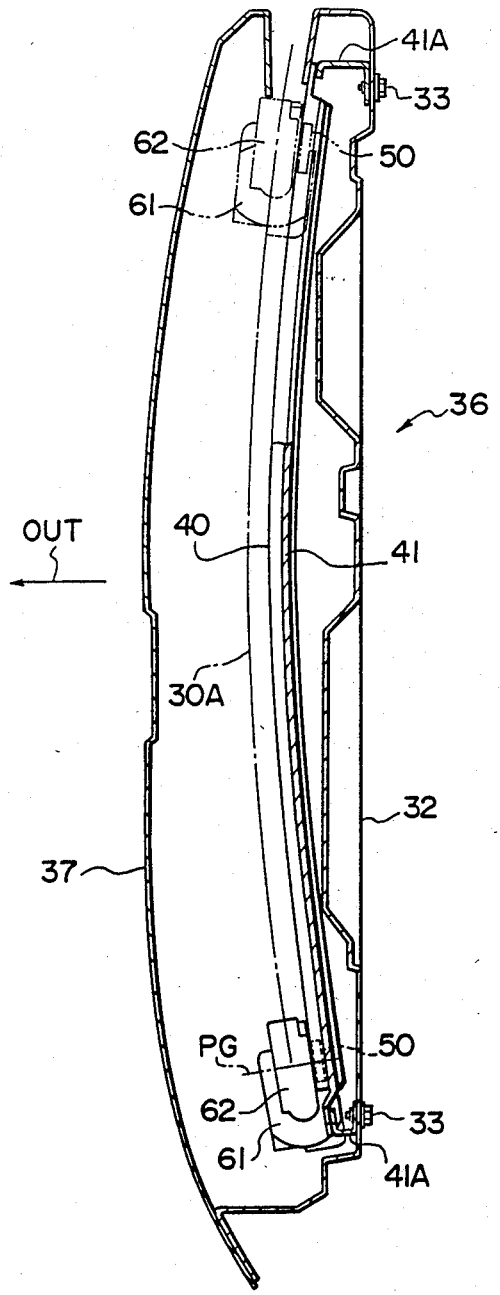
FIG. 6 is a sectional view taken along the line VI—VI of FIG. 1.

The rack 40 is provided with rack teeth 40A formed on the surface thereof facing rearward as viewed in the direction of running of the vehicle. The rack 40 is fixed such that its longitudinal axis extends in the direction of movement of the pinion 50 as indicated by an arrow WG, and is fixed at its one side surface to a rack mounting bracket (referred to simply as "bracket" hereinafter)41. As can be seen from FIG. 6, the rack 40 and the bracket 41 are curved so as to convex in a plane which is perpendicular to the breadthwise direction of the window glass towards the exterior of the vehicle as indicated by n arrow OUT in FIG. 6 and is substantially in conformity with the curvature of the window glass 30. In FIG. 6, the path of movement of the neutral axis of the window glass is denoted by a numeral 30A. The bracket 11 is provided with substantially C-shaped fixing tabs 41A formed on the upper and lower ends thereof. These fixing tabs 41A are fastened to the inner panel 3 by means of bolts thereby fixing the bracket 41 to the door 36.

Figure 5:
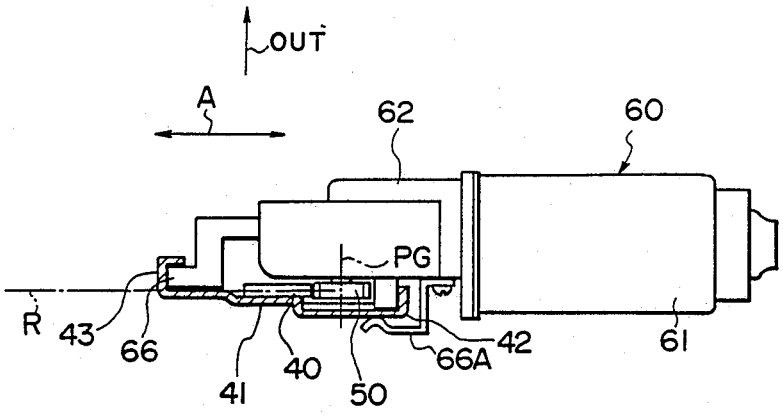
FIG. 5 is a sectional view taken along the line V—V of FIG. 4.

As can be seen from FIG. 5, the bracket 41 is provided on both breadthwise ends thereof with hook-shaped engaging portions 42 and 43. More specifically, a substantially L-shaped engaging portion is formed on the front end (left end as viewed in FIG. 5) of the bracket 41 so as to project outwardly of the vehicle, i.e., in the direction of the arrow OUT. On the other hand, the rear end of the bracket 41 is turned substantially at a right angle to project outwardly from the vehicle so as to provide an engaging portion 42. A gear housing 62, rotatably supporting the pinion 50 is fixed to the motor 60 in such a way that the output power of the motor 60 is transmitted to the pinion 50 at a reduced speed. As will be seen from FIG. 6, the axis PG of the pinion gear 50 orthogonally crosses the longitudinal axis of the rack 40 as viewed in the longitudinal direction of the vehicle.

A detailed description will be given of the gear housing 62. The gear housing 62 has a member for fixing the body 61 of the motor to the rail 80 which is one of the constituents of the slide supporting mechanism 70 and a member for locating the bracket 41 and the motor body 61.

Figure 7:
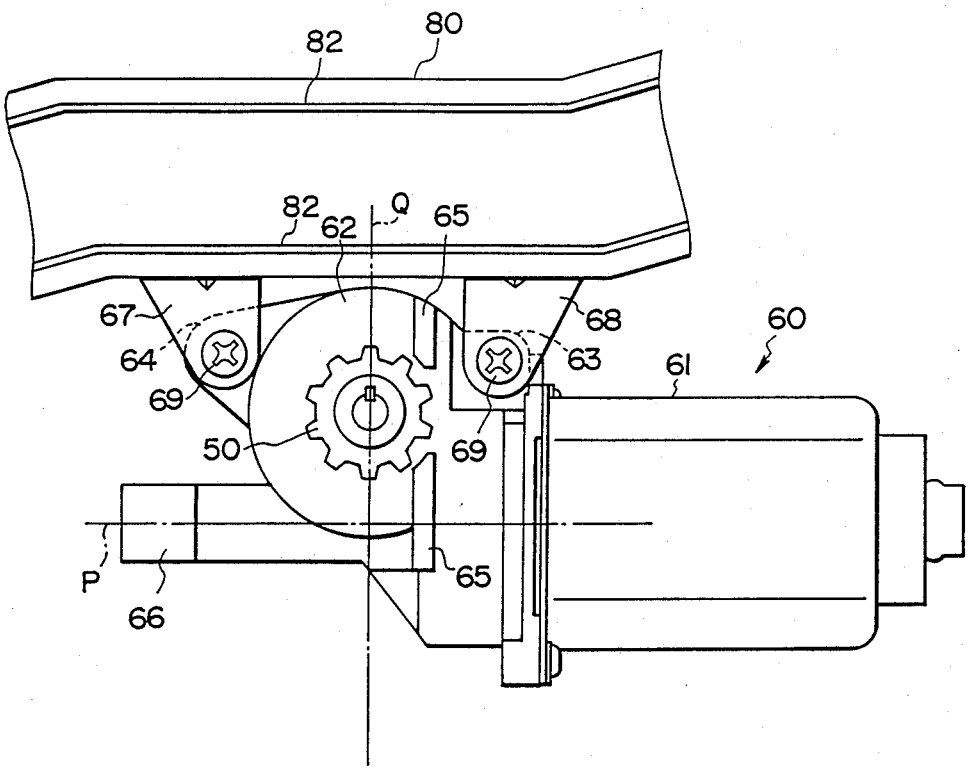
FIG. 7A is an enlarged view of the arrangement of FIG. 4, with a rack mounting bracket being removed so as to show a gear housing.
FIG. 7B is an exploded perspective view showing an arrangement for mounting a motor and rails.
Figure 7B:
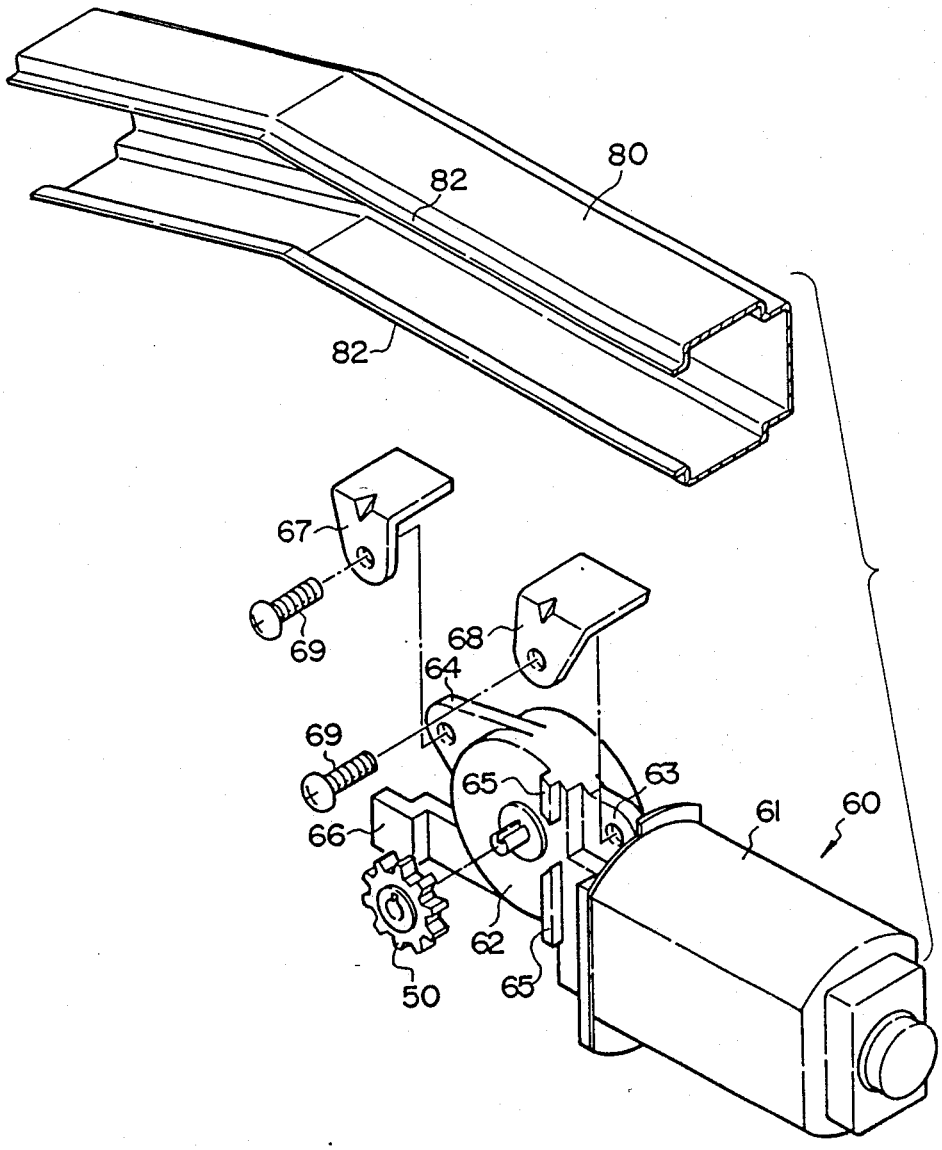

More specifically, as will be seen from FIG. 7A, lugs 63 and 64 for securing the motor 60 to the rail 80 is provided on the upper end of the gear housing 62. Referring no to FIG. 7B, substantially L-shaped brackets 67 and 68, which are fixed to the rail 80 at one of their ends, are fixed to the lugs 63 and 64 by means of bolts 69. The motor 60 is thus fixed to the rail 80. In consequence, the rail 80 is connected through the motor 60 to the rack mounting bracket 41 and the rack 40.

Furthermore, projections 65 and 66 are formed on the gear housing 62 so as t engage the engaging portions 42 and 43. The projection 66 is inserted into the space between the end of the engaging portion 43 and the rack mounting bracket 41 from the rear side of the vehicle. The projection 65 is inserted laterally and inwardly toward the vehicle and into contact with the bracket 41 so as to contact the surface of the engaging portion 42 which faces in a forward direction of the vehicle. In order to prevent the projection 65 from coming off the rack mounting bracket 41, an arm 66A projects from the gear housing 62 so that the end of the arm 66A cooperates with the projection 65 in clamping the rack mounting bracket therebetween.

With this arrangement, the projections 65 and 66 cooperate with the engaging portions 42 and 43 so as to maintain the pinion 50 and the rack 40 in a proper meshing engagement. Thus, the meshing engagement between the pinion 50 and the rack 40 is maintained stability regardless of the up and down movement of the pinion 50 along the rack 40 when the pinion 50 is driven by the motor 60 so as to rotate about its own axis.

As can b seen from FIG. 7A, the projection 65 is provided in pairs so as to project from the gear housing 62 and makes contact with the rack mounting bracket 41 at two positions which are spaced from each other in the longitudinal direction of the bracket 41. Thus, the pair of projections 65, in cooperation with the projection 66, provide three support points at which the gear housing 62 is supported on the rack mounting bracket 41, whereby the motor 60 is stabily supported on the rack mounting bracket 41.

The slide supporting mechanism 70 will be described in detail with specific reference to FIGS. 1 to 3.

Referring to these Figures, the slide supporting mechanism 70 used in this embodiment has a rail which is fixed to the motor 60 and which is an example of the slide guide member. A pair of rollers are examples of slider means supported by the window glass 30, and a ball pin 95 is an example of the rotary member.

The rail 80 has a substantially C-shaped sectional shape and is provided such that its longitudinal axis extends in the breadthwise direction (see arrow A) of the window glass 30. The rail 80 has an overall breadth L with its opening restricted as indicated at 82.

A roller supporting plate 10 is fixed at both its ends to the lower end of the window glass near both breadthwise ends thereof, by means of mounting pieces 102.

Figure 2:
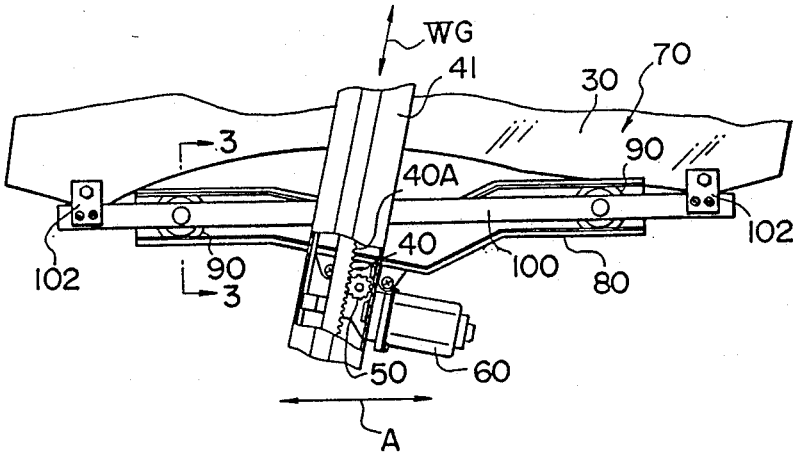
FIG. 2 is a partly cut-away enlarged view of an essential portion of the embodiment shown in FIG. 1.

The roller support plate 100 rotatably carries the rollers as shown in FIG. 2, so that the rollers 90 can move along the length of the rail 80.

A description will be given of the rollers 90 and the ball pin 95 with specific reference to FIG. 3.

Each roller 90 has a cylindrical portion 92 which makes rolling contact with the broad portion (breadth L) of the rail 80. These rollers 90, which roll on the rail 80 permit the motor 60 and the window glass 30 to move relative to each other in the direction of the arrow A in FIG. 2. The cylindrical portion 9 has a diameter greater than the width of the restricted opening of the rail 80 so that the roller 9 is prevented from coming off the rail 80 in the direction of the roller axis. A substantially spherical cavity formed in the roller 90 holds a spherical portion of the ball pin 95. The ball pin 95 is rotatable or tiltable in a plane which is perpendicular to the longitudinal axis of the rail 80 and which contains the axis of the ball pin 95, i.e., in the directions of the double-headed arrow B in FIG. 3. The end of the ball pin 95 projecting from the roller 90 is fixed to the roller support plate 100 mentioned above. This pivotal motion of the ball pin 95 indicated by the arrow B enables the pinion 50 to follow the rack 40 even when the path of movement of the window glass 30 is curved in a plane containing the axis of the ball pin 95 as shown in FIG. 6.

The operation of the self-driving power window will be described hereinafter.

As the passenger operates a switch (not shown), the motor 60 is energized so that the power derived from the motor body 61 is transmitted to the pinion gear 50 with a reduced speed.

In consequence, the pinion 50 rotates about its own axis and moves along the rack 40 in meshing engagement therewith as indicated by the arrow WG. The power of the motor 60 therefore is transmitted to the window glass 30 through the rail 80 and the roller supporting plate 100 so as to drive the window glass 30 in the direction for opening or closing the window.

Thus, in the self-driving power window regulator, the motor 60 also moves as a unit with the window glass 30 which is the closure member to be driven. In the described embodiment, the stable meshing engagement between the rack 40 and the pinion gear 50 is maintained and the motor 60 is smoothly moved along the rack 40 by virtue of the engagement between the first and second engaging projections 65, 66 of the gear housing 62 and the engaging portions 42, 43 of the bracket 41.

The guide 35 that s secured to the door 36 limits the direction o movement of the window glass 30 that is driven by the motor 60 so that the window moves only in the direction indicated by the arrow WG.

A drivation may be caused in this embodiment between the path of movement of the motor 60 and the path of movement of the widow glass 30, due to, for example a dimensional error or error incurred in the course of assembly. More specifically, the guide 35 and the bracket 41 are secured to the door 36 independently of each other so that an error may be caused in positions of these parts relative to each other. It is also to be pointed out that the abovementioned possible deviation tends to increase due to the presence of a certain play existing between the window glass 30 and the guide 35.

In this embodiment, however, such deviation can conveniently be absorbed by the relative movement allowed between the glass and the motor, so that the window can move smoothly despite the presence of such a deviation.

For instance, when the guide 35 and the rack 40 are not arranged with a required high degree of parallelism, the window glass 30 is allowed to move up down with a positional offset in the breadthwise direction thereof from the correct position, i.e., at a deviation from the direction WG. Namely, such a positional offset of the window glass is absorbed by the relative horizontal movement between the rollers 90 and the rail 80 secured to the motor 60, i.e., by the movement of the rollers 90 on the rail 80 in the longitudinal direction of the rail 80. This arrangement therefore eliminates any risk for the meshing parts of the rack and pinion to be overloaded and ensures that the pinion and rack are stably held in meshing engagement with each other, thus offering a smooth opening and closing operation.

As a matter of fact, it is only seldom that the curved path 30A of movement of the window glass 30 and the curved rack 40 are secured to the door 36 with the required high degree of parallelism wit respect to each other. In other words, the window glass 30 is often obliged to move along a path which is slightly inclined with respect to the rack 40 due to reasons such as a difference in the curvature or relative inclination between the path of the window glass 30 and the rack 40. According to the invention, however, such a slight relative inclination does not cause any problem because the ball pins 95 are tiltable as indicated by the arrow 3 in FIG. 3 with respect to the axes of the rollers 90. This keeps the pinion and the rack always in good meshing engagement with each other while avoiding the overloading of these parts.

Figure 3:
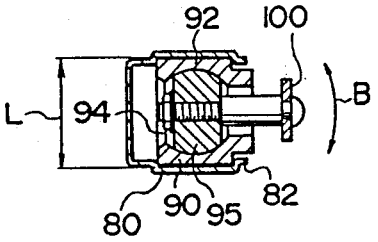
FIG. 3 is a sectional view take along the line III—III of FIG. 2.
Figure 4:
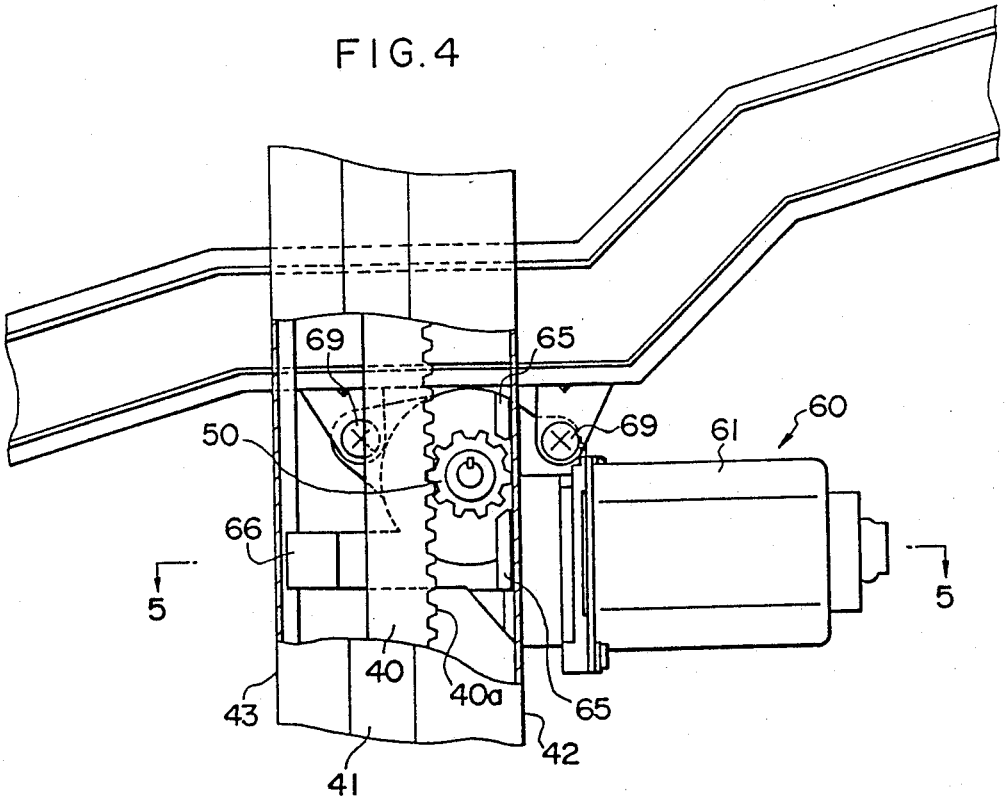
FIG. 4 is an enlarged view illustrating the state of meshing engagement between a rack and a pinion.

Thus, in the described embodiment, the window glass 30 and the motor 60 are connected to each other with degrees of freedom of relative movement in the directions of arrows A and B in FIGS. 2 and 3, so that the requirement for dimensional precision of parts, as well as requirement for laborious adjusting work in assembly, can be advantageously avoided.

The second to the fourth embodiments of the present invention will be described with reference to FIGS. 8 to 10.

Figure 8:
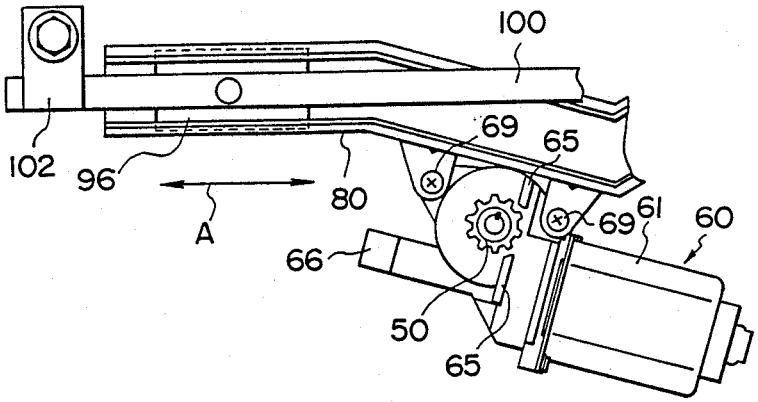
FIG. 8 is a front elevational view corresponding to FIG. 2 but showing a second embodiment of the present invention.

Referring to FIG. 8 which shows the second embodiment, a rectangular block-type slider 96 is slidably mounted on the rail 80 so as to impart a degree of freedom only in the longitudinal direction (direction of arrow A) of the rail 80. This arrangement effectively absorbs the greatest offset experienced in this type of self-driving power window, i.e., the positional offset occurring between the window glass and the motor in the breadthwise direction of the window glass 30.

Figure 9:
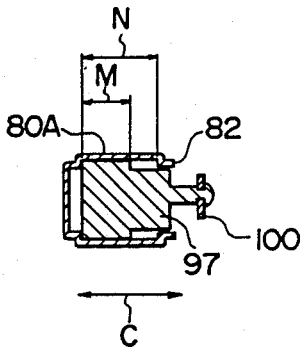
FIG. 9 is a sectional view corresponding to a longitudinal sectional view of the arrangement of FIG. 8 but showing third embodiment of the present invention.

FIG. 9 shows the third embodiment in which, as in the case of the second embodiment, a rectangular slide 97 provided a degree of freedom in the direction of the breadth of the window glass 30 (direction of arrow A in FIG. 1) so as to permit relative movement between the window glass and the motor in the above-mentioned direction. In addition, the slider 97 has a stepped outer configuration so that it is allowed to move in this direction of thickness of the window glass 30 (direction of arrow C) within a range in the rail 80 which is limited by the restricted opening 82 of the rail 80, so that a degree of freedom of movement is given also in the direction of thickness of the window glass 30. More specifically, the width M of the greatest portion 97A of the slider 97 is determined to be greater than the breadth N of the ample portion 80A of the rail 80 so that the slider 97 is allowed to move in the breadthwise direction of the vehicle (arrow C) within a range which is expressed as the difference (N−M) between these breadths. Thus, the third embodiment offers an advantage in that the window glass 30 is supported with degrees of freedom both in the direction of the breadth of the window glass 30 (direction perpendicular to the plane of sheet of FIG. 9) and in the direction of thickness (arrow C) of the window glass 30.

Figure 10:
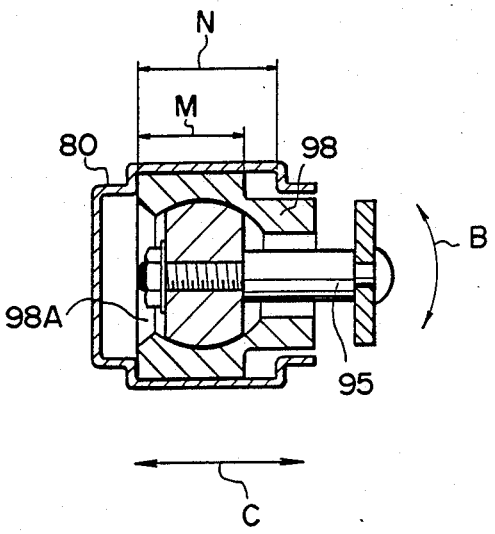
FIG. 10 is a sectional view corresponding to FIG. 3, but showing a fourth embodiment of the present invention.

FIG. 10 shows the fourth embodiment of the present invention. This embodiment incorporates both the features shown in FIG. 2 and FIG. 9. Namely,, the fourth embodiment incorporates sliders 98 having an outer configuration which is the same as that of the sliders 97 shown in FIG. 9. The slider 98 has a cylindrical cavity 98A substantially the same as that in the roller 90 shown in FIG. 3. A ball pin 95 similar to that shown in FIG. 3 is received in this cavity 98A. This arrangement provides a degree of freedom of movement in rotational directions (directions of arrow B) in the plane perpendicular to the longitudinal axis of the rail 80, in addition to the degree of freedom in the direction of the breadth of the window glass 30 (direction perpendicular to the sheet of FIG. 10) and the direction of thickness of the window glass 30 (direction of arrow C). Thus, the window glass 30 of the self-driving power window and the motor 60 in this embodiment can be connected to each other with degree of freedom of movement in three directions, thus enabling the absorption of offset between the path of movement of the window glass 30 and the path of movement of the motor 60 occurring in any direction.

Figure 11:
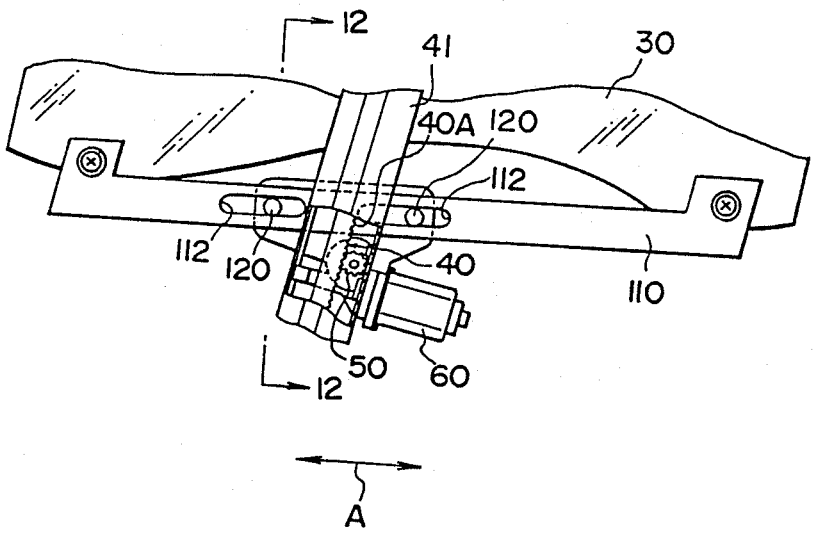
FIG. 11 is a front elevational view corresponding to FIG. 2 but showing a fifth embodiment of the present invention.

FIG. 11 shows a fifth embodiment of the present invention which offers functions equivalent to or more than that offered by the first embodiment with a smaller number of parts than the first embodiment.

The fifth embodiment employs a slide supporting plate 110 which extends in the longitudinal direction of the vehicle and which is fixed at its both ends to the window glass 30, as is the case of the roller supporting plate 100 used in the first embodiment shown in FIG. 2. The slide supporting plate 110 is provided with a pair of elongated holes 112 which have longitudinal axes extending in the direction of the breadth of the window glass 30. Each elongated hole receives a slide pin 120 which is fixed to the gear housing 62 and which has a longitudinal axis extending in the direction of thickness of the window glass, i.e., transversely of the vehicle.

With this arrangement, the slide pin 120 is movable within the associated elongated hole 112 so as to absorb any positional offset occurring between the widow glass 30 and the motor 60 in the breadthwise direction of the window glass (direction of arrow A) during the movement of the window glass 30. On the other hand, any offset taking place in the direction of thickness of the window glass 30 (direction perpendicular to plane of sheet of FIG. 11) can be absorbed by the movement of the slide pin 120 in the direction of insertion or withdrawal, i.e., in the axial direction of the slide pin 120. Thus, degrees of freedom of movement in two directions can be obtained with a reduced number of parts as compared with the first embodiment so that the window regulator constructed in accordance with this fifth embodiment can be produced with reduced production costs as compared with the window regulator of the first embodiment.

The configuration and the manner of mounting of the slide pin 120 shown in FIG. 11 are only illustrative and may be modified in various forms as will be explained hereinunder with reference to FIGS. 12A to 12E.

Figure 12A:
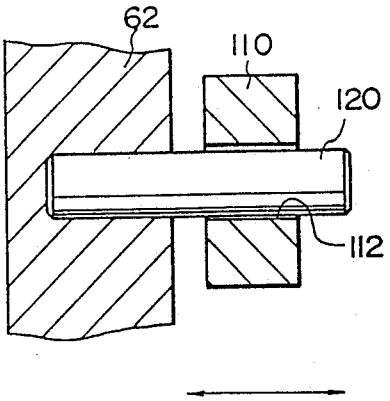
FIGS. 12A to 12E are sectional views taken along the line XII—XII of FIG. 11, illustrative of various forms of constructions for mounting a slide pin.

In FIG. 12A, the slide pin 120 is press-fitted at its one end into the wall of the gear housing 62.

Figure 12B:
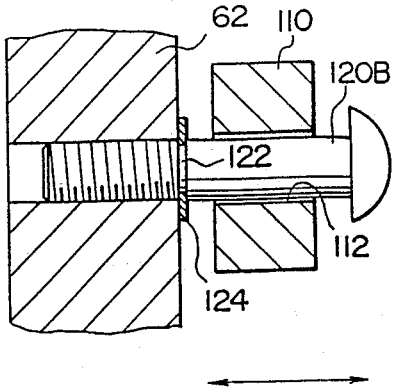

In FIG. 12B, a slide pin 120B is provided at its intermediate portion with a groove 122 in which a C-shaped ring 124 is fitted, and the thus formed slide pin 120B is screwed to the gear housing 62.

Figure 12C:
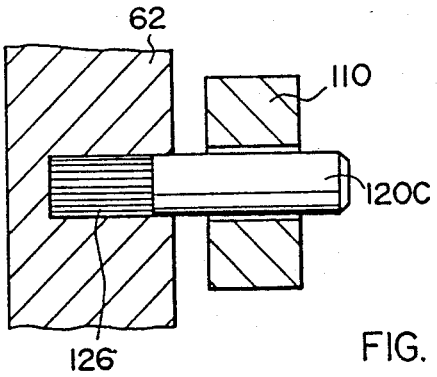

In FIG. 12C, a slide pin 120C is provided with serration on its one end 126 and is press-fitted to a hole in the wall of the gear housing 62 at the end having the serration.

Figure 12D:
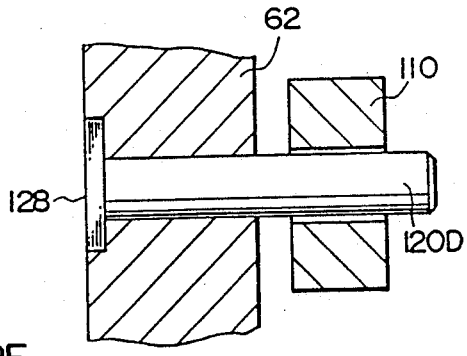
Figure 12E:
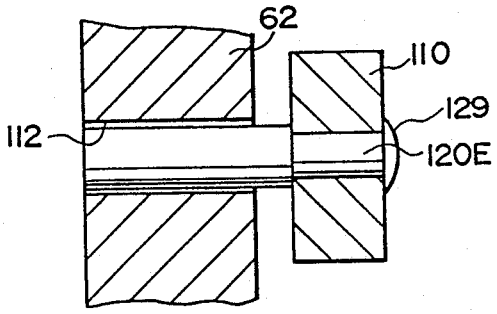

In FIG. 12D, a slide pin 120D, that is radially expanded at its one axial end as denoted by 128 is provided. The slide pin 120D is extended through a hole formed in the wall of the gear housing 62 so that the radially expanded end 128 serves as a stopper.

In Fig. E, a slide pin 120E is caulked at its head as seen at 129 so as to be fixed to the slide supporting member 110 and is received in an elongated hole 112 formed in the gear housing 62 in such a way that the slide pin 102E is slidable in the direction perpendicular to the plane of sheet of this Figure.

A sixth embodiment of the present invention, which offers a high degree of precision of sliding movement in the direction of degree of freedom, will be described with specific reference to FIGS. 13 to 15.

The sixth embodiment has a slider 140 which extends in the longitudinal direction of the vehicle as is the case of the roller supporting plate 100 show in FIG. 2. The slider 140 is supported at both its sides on the window glass 30 through slide angle members 150. The slider 140 is also supported at its intermediate portion by a bracket 41 through a rail 130 and a motor 60.

The rail 130 is connected to two longitudinally intermediate portions of the rail 130. More specifically, a pair of arms 130A and 130B project form an intermediate portion of the rail 130 so that the portion of the rail 130 having these projections 130A, 130B exhibits a substantially C-shaped cross-section and this portion of the rail holds the slider 140. Thus, the rail 130 and the slider 140 are slidable relative to each other in the longitudinal direction (arrow A) of the vehicle.

Figure 15A:
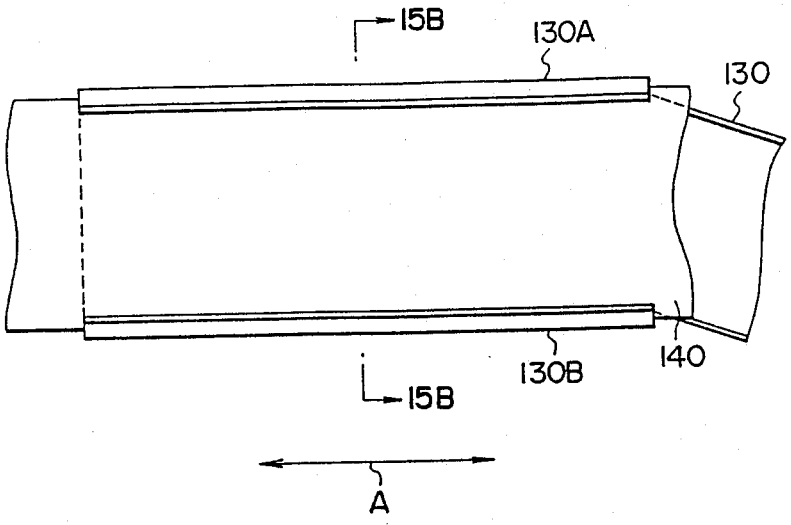
FIG. 15A is an enlarged view of the portion marked at XVA in FIG. 13.
Figure 15B:
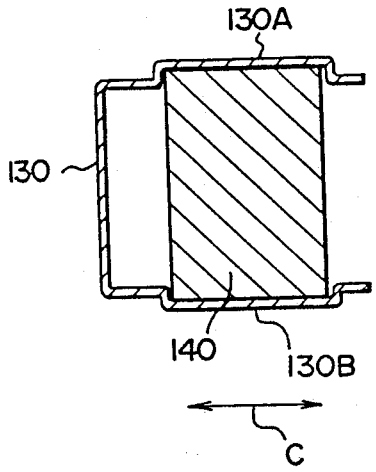
FIG. 15B is a sectional view taken along the line XVB—XVB of FIG. 15A.

The end extremities of the arms 130A and 130B are bent towards each other so as to reduce the distance therebetween in order to prevent any relative movement between the rail 130 and the slider 140 in the direction of the arrow C (see FIG. 15B).

The window glass 30 is supported with a degree of freedom of movement in the directions of thickness of the window glass 30 (directions of arrow C in FIG. 16) with respect to the slider 140.

Figure 13:
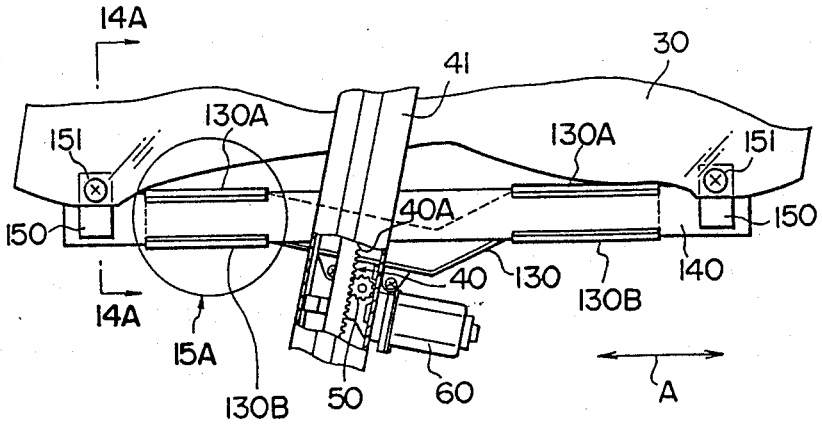
FIG. 13 is a front elevational view corresponding to FIG. 2 but showing a sixth embodiment of the present invention.
Figure 14A:
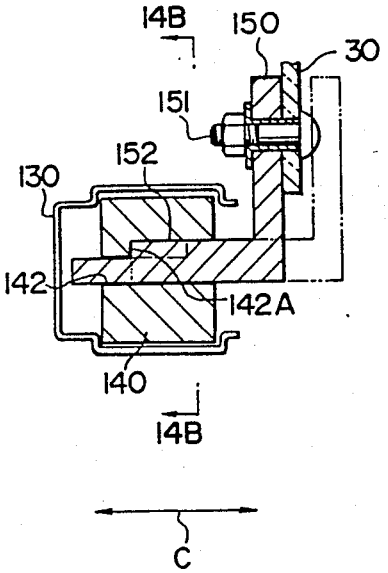
FIG. 14A is a sectional view taken along the line XIVA—XIVA of FIG. 13.
Figure 14B:
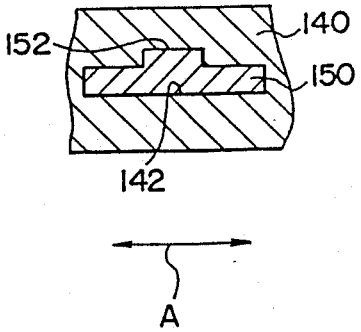
Figure 16:
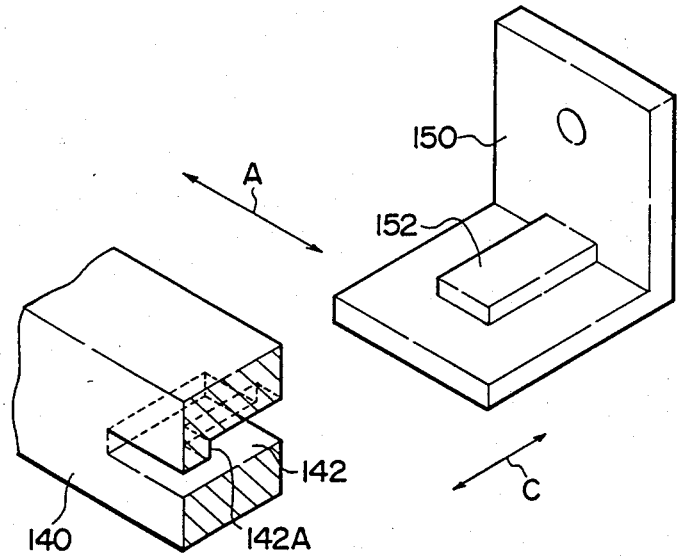
FIG. 16 is a partially cut-away perspective view showing the relationship between a slider and a slide angle in the sixth embodiment.
Figure 17:
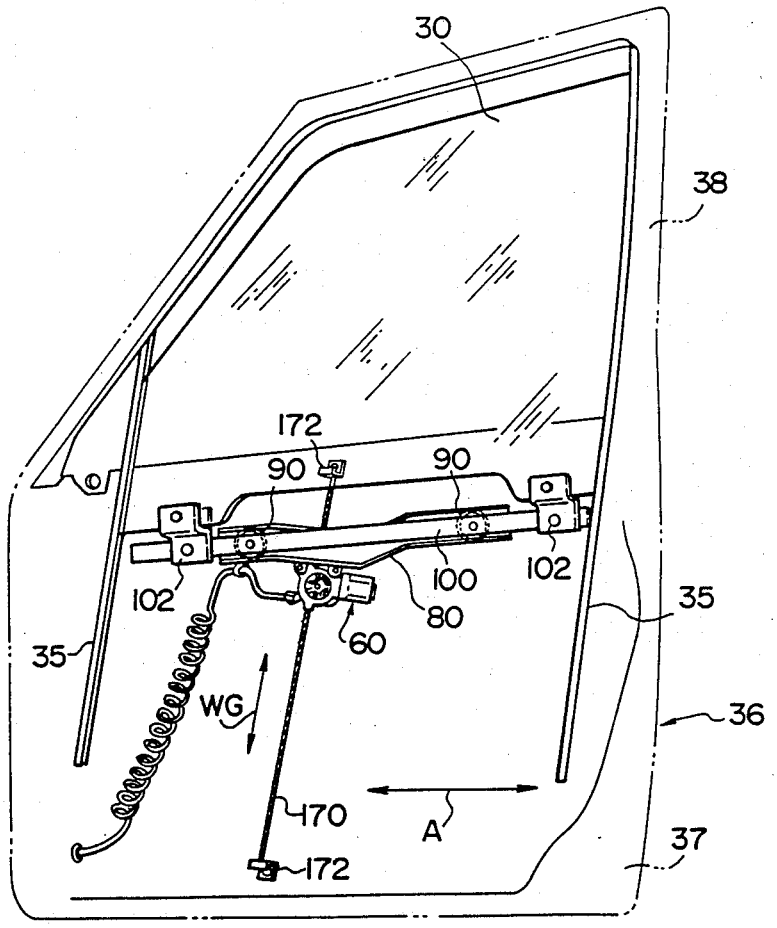
FIG. 17 is a side elevational view of a door corresponding to FIG. 1 but showing a seventh embodiment of the present invention.

Namely, as can be seen from FIG. 14A, which is a sectional view taken along the line XIVA—XIVA of FIG. 13, as well as from FIG. 16, a slide angle member 150 is fixed at its one end to each breadthwise end of the window glass 30 by means of a bolt 151. The other end of the slide angle member 150 is received in a slide hole 142 formed in each longitudinal end of the slider 140 so that it is slidable in the direction of the thickness of the window glass 30 as indicated by arrow C in FIG. 16. The slide angle member 150 is provided on the upper surface thereof with a protrusion 152 while a mating recess is formed in the wall of the slide hole 142. The inner end of the mating recess stops the inner end surface of the protrusion 152 thereby limiting insertion, i.e., the sliding motion, of the slide angle member 150.

With this arrangement, any offset of the window glass 30 in the breadthwise direction thereof (direction of arrow A) can conveniently be absorbed by the sliding motion between the rail 130 and the slider 140. In particular, since the slider 140 extends in the direction of the arrow A, the relative sliding movement between the window glass 30 and the motor 60 in the breadthwise direction of the window glass 30, can be performed in a stable manner.

On the other hand, any offset of the window glass 30 in the thickness wise direction((direction of arrow C) of the window glass 30, can be absorbed by the relative sliding motion allowed between the slide angle members 150 which are fixed to the window glass 30 and the slide holes formed in the slider 140. Since this sliding motion can be performed at both breadthwise ends of the window glass 30, the window glass 30 can be moved in quite a stable manner.

FIGS. 17 to 21 show a seventh embodiment of the present invention.

This embodiment employs a wire 170 in place of the rack and pinion type driving system used in the preceding embodiments. As can be seen from FIG. 17, the wire 100 is anchored at both its ends to the door outer penal 37 through anchoring members 172 so as to extend in parallel with a guide 35 at a slight inclination with respect to a vertical line, as indicated by an arrow WG. As can be seen from FIGS. 20 and 21, the anchoring member 172 has a substantially L-shaped form. One of the anchoring members 172 penetrates and anchors the associated end of the wire 170 by a stopper 174 fixed to the end of the wire 170. The other anchoring member 172 is fixed to the outer panel 37 by means of a bolt 176 and a nut 178. The bolt 176 extends through an elongated hole 180 formed in the outer panel 37 so that the position of mounting of the outer panel 37 is adjustable o impart a tension to the wire 170. The anchoring member 172 is fixed to the door inner panel 32, although it is fixed to the door outer panel 37 in the illustrated embodiment.

The wire 170 is made from any suitable material such as stainless steel, carbon fibers, glass fibers or the like.

Figure 18:
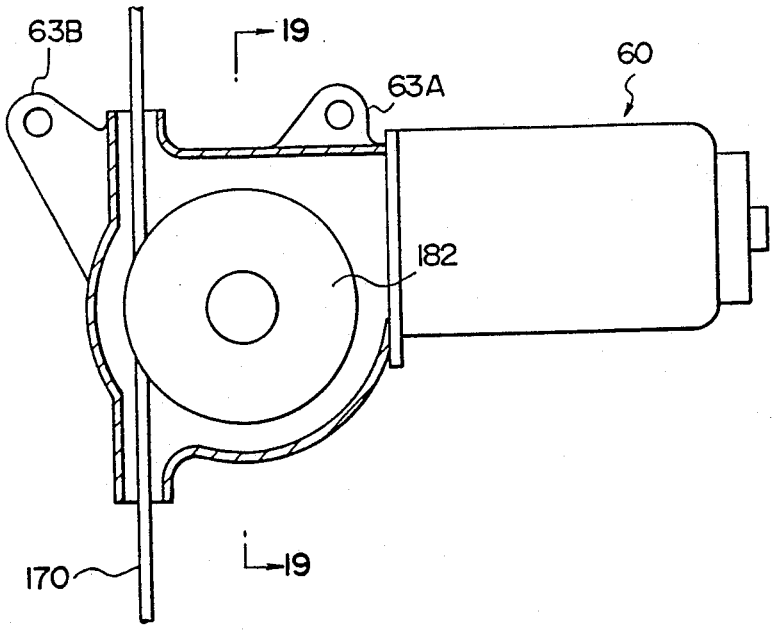
FIG. 18 is a partly sectioned enlarged view showing a motor gear housing of the seventh embodiment.
Figure 19:
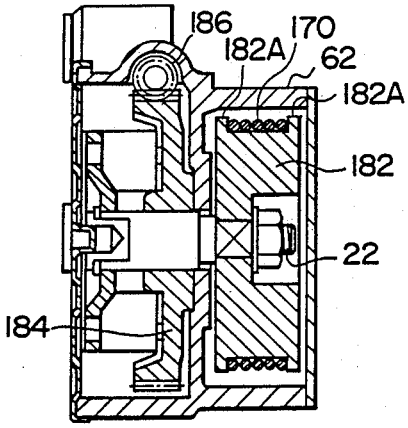
Figure 20:
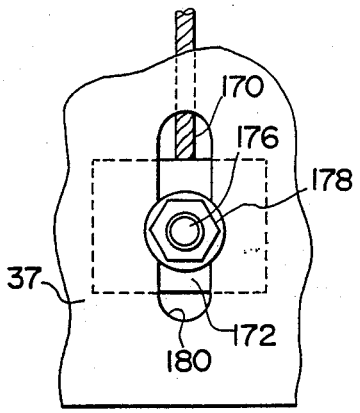
FIG. 20 is an enlarged view showing the structure for connecting a wire to a door.
Figure 21:
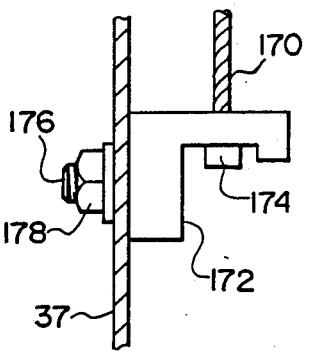
FIG. 21 is a side elevational view of the structure shown in FIG. 20.
Figure 22:
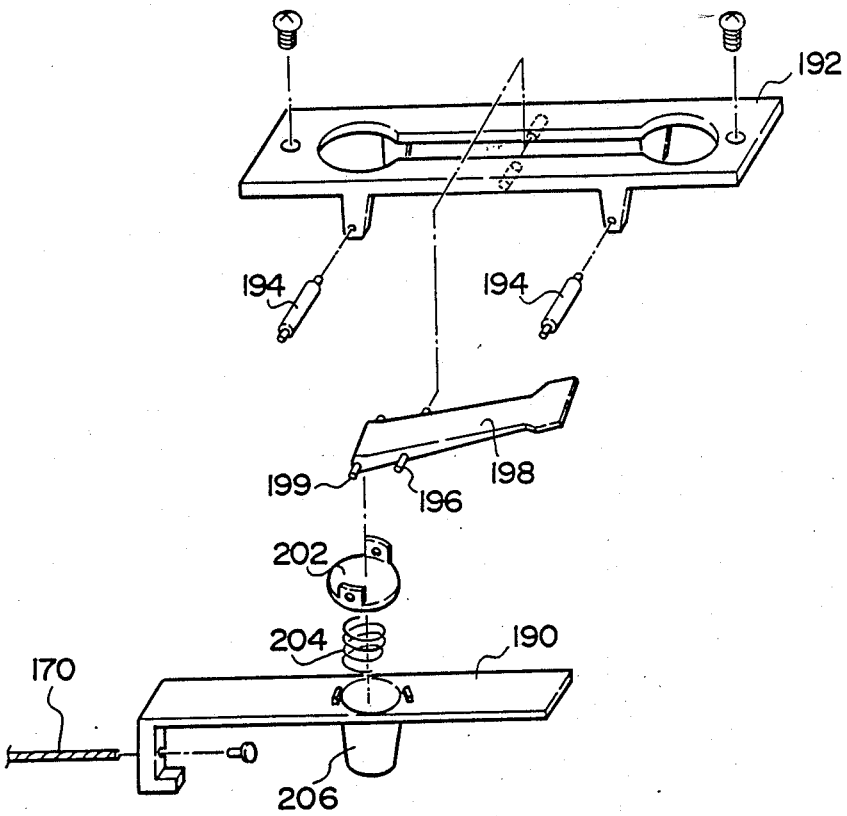
FIG. 22 is an exploded perspective view showing the construction for securing an end of a wire.

As can be seen from FIGS. 18 and 19, the wire 170 has an intermediate portion which is wound spirally around a drum 180 so as to bear any rotational reactional force on the drum 182. The drum 182 is provided, at both its axial ends, with an enlarged portions or flanges so as to prevent the winding of the wire 170 from coming off the drum 182. The drum 182 is disposed in a gear housing 62 and is coaxially fixed to a worm wheel 184 which is rotatably supported by the gear housing 62. The worm wheel 184 engages a worm gear 186 which is carried by the output shaft of the motor.

As in the case of the first embodiment, a rail 80 is fixed to mounting lugs 63A and 63B projecting from the gear housing 62.

In operation of the seventh embodiment, as the motor 60 is energized, the drum 182 is rotatingly driven by the power of the motor 60 through the worm gear 186 and the worm wheel 184. This cause the drum 182 to take up the wire from one side thereof while paying off or extending the wire from the other end thereof, so that the motor 60 is moved up and down together with the rail 80. Namely, a clockwise rotation of the drum 182 as viewed in FIG. 18 causes the portion of the wire 170 near the lower end thereof to be taken up by the drum 182 so that the motor 60 is thrust downward, whereas a counter-clockwise rotation of the drum 182 causes the motor 60 to be thrust upward.

The upward or downward thrust exerted on the motor 60 is transmitted to the window glass 30 through the rail 80, the rollers 90 and the roller supporting plate 100 so that the window glass 30 is moved up and down as in the cases of the preceding embodiments. In the event that the path of movement of the window glass 30 is not precisely parallel with the wire 170, i.e., when a slight deviation exists in the breadthwise direction of the window glass, such a deviation is conveniently absorbed by the relative movement between the rollers 90 and the rail 80 in the longitudinal direction of the rail 80 (direction of arrow A).

Although not shown, the rollers 90 are constructed to allow a rotating motion as explained before in connection with FIG. 3.

Although the wire 170 is extended in a direction which is incline to the vertical direction, it is arranged to extend in the vertical direction. It is also to be understood that the guide 35 may also be arranged vertically to guide the window glass 30 when moving vertically up and down. It is also possible to suitably incorporate the features of the second to the sixth embodiments in the basic arrangement of the seventh embodiment which relies upon the wire 170.

In order to safely guide the turns of the wire 170 on the drum 182, spiral grooves are provided on the outer peripheral surface of the drum 182.

The wire 170 is substituted by a timing belt having teeth on the outer peripheral surface, or a chain, in combination with a sprocket wheel used in place of the drum 182, so that the teeth or holes of the chain can securely engage the teeth on the sprocket so as to ensure the transmission of the power without slipping. In such a case, it is not necessary that the timing belt or the chain is wound fully around he sprocket. Namely, it only suffices that the timing belt or the chain engages with a portion of the circumference of the sprocket.

FIGS. 22 and 23A to 23C show an eighth embodiment of the present invention in which the wire 170 is anchored at both its ends under application of a tension.

More specifically, in this embodiment, the wire 170 is connected to a slide plate 190. The slide plate is slidable in the direction of extension of the wire 170 with respect to an anchoring plate 192 which is fixed to the inner panel of the door 32 and which is provided with rollers 194 rotatably carried thereon. A spring retainer 202, which fastened by pins 199 to one end of a swing lever 198 that is pivotally connected to the anchoring plate 192 by pine 196, is pressed onto one end of a coil compression spring 204 which is received in a spring case 206 formed in an intermediate portion of the slide plate 190.

Figure 23A:
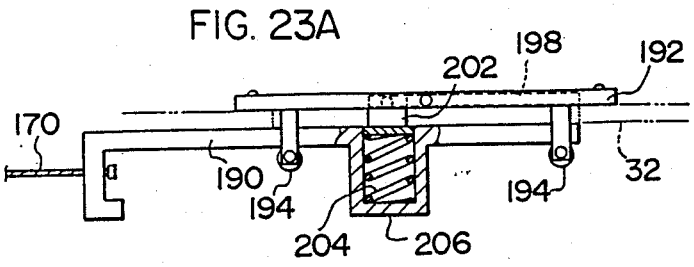
FIGS. 23A to 23C are sectional views illustrating the states of tension applied by the arrangement shown in FIG. 22.
Figure 23B:
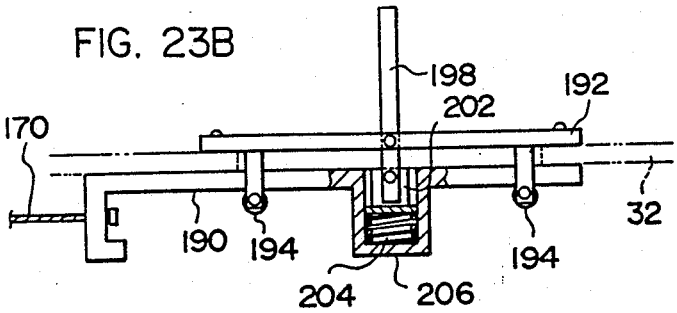

Therefore, the swingable lever 198 can make a toggle action, i.e., urged clockwise or counter-clockwise by the force of the spring 204 depending on whether the lever 198 is on the left or right side of the neutral position in which it stands upright from the anchoring plate 12 as shown in FIG. 23B.

Figure 23C:
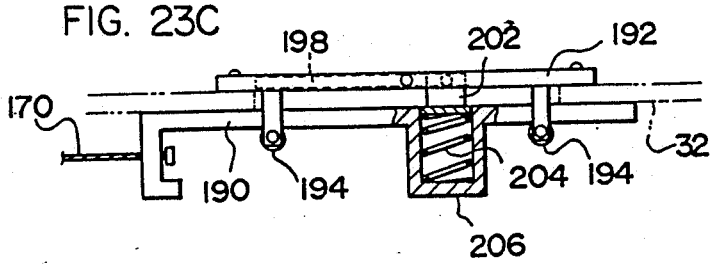
Figure 24:
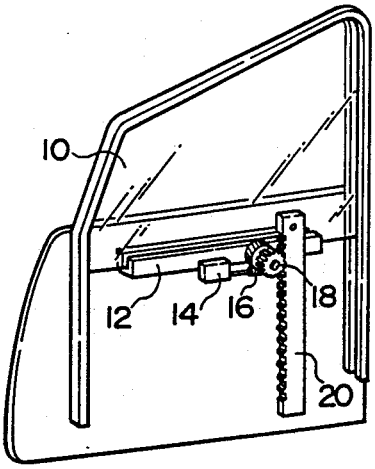
FIG. 24 PRIOR ART
FIG. 24 is a perspective view of a conventional window glass regulator employing a rack-pinion type driving system.

When the wire 170 is wound around the drum, the swingable lever 198 is turned and set in the position shown in FIG. 23A so as to loosen the wire 170. Thereafter, the swingable lever 198 is turned and set in the position shown in FIG. 23C, past the position of FIG. 24R, so that the wire 170 can be secured in a tension state. Once this state is obtained, any unintentional clockwise rotation of the swingable lever 198 about the pin 196, as viewed in FIG. 23C, is prevented because of the presence of the urging force exerted by the spring 204.

Although the invention has been described through its preferred forms, it is to be understood that the described embodiments are only illustrative and various changes and modifications may be imparted thereto.

For instance, the slide type connections used in the described embodiments for the purpose of providing degrees of freedom of movement in various directions are only illustrative and may be substituted by other suitable forms. It is also to be understood that the guide means or guiding the movement of the motor in such a manner as to keep the rack and pinion in engagement with each other may be modified in various forms.

Although a power window of a vehicle has been specifically mentioned, it is to be understood that the present invention can be applied to various other uses which employ closure members to be driven between open and close positions. In the case of an automobile, the invention can suitably be used for sun-roof systems which have becoming popular in recent years.

What is claimed is:

1. A closure device mounted on a stationary part such as a door of a vehicle and capable of driving a closure member such as a window glass, said device comprising:

(a) a guide member provided on said stationary part and capable of guiding said closure member by moving between an open position and a close position;

(b) driving force bearing means extending in the direction of movement of said closure member;

(c) a power source movable together with said closure member and capable of generating a driving force and causing said driving force bearing means to bear the driving force thereby so as to drive said closure member by the reactional force; and (d) relative movement means for allowing said power source and said closure member to move relative to each other in a direction which crosses the direction of movement of said closure member between said open and close positions, thereby absorbing any offset between the direction of movement of said closure member between said open and close positions and the direction of movement of said power source so as to ensure that the driving force is securely borne by said driving force bearing means.

2. A closure device according to claim 1, wherein said driving force bearing means includes a rack fixed to said stationary part, while said power source includes a pinion meshing with said rack so that the driving force produced by said power source is borne by said rack through said pinion and said reactional force is transmitted to said pinion and to said power source, whereby said driving source and said closure member are moved along said rack.

3. A closure device according to claim 1, wherein said driving force bearing means includes a wire which is anchored to said stationary part at both ends thereof, and said power source drives a drum on which an intermediate portion of said wire is wound so that the rotational force exerted by said drum is borne by said wire while the drum moves along the length of said wire thereby driving said closure member between said open and close positions.

4. A closure device according to claim 1, wherein said relative movement means includes a rail fixed to either one of said power source and said closure member and having a longitudinal axis crossing the direction of movement of said closure member between said open and close positions, and a moving member fixed to the other of said power source and said closure member and movable along the length of said rail.

5. A closure device according to claim 4, wherein said moving member is roller having an axis of rotation extending orthogonally to the longitudinal axis of said rail.

6. A closure device according to claim 5, wherein said axis of rotation of said roller is tiltable in a plane which is perpendicular to the longitudinal axis of said rail and which contains said axis of rotation of said roller, so as to absorb any deviation between paths of movment of said power source and said closure member which may occur when said path of movement of said closure member is curved in a plane containing said axis of rotation of said roller.

7. A closure device according to claim 4, wherein said moving member includes a slider which is movable in the longitudinal direction of said rail and also slightly movable in the breadthwise direction of said rail.

8. A closure device according to claim 1, further comprising second relative movement means capable of absorbing any offset between said power source and said closure member in the direction orthogonal to the direction of absorption of offset performed by said relative movement means.

9. A closure device according to claim 8, wherein said second relative movement means includes a pin provided on either one of said power source and said closure member and a hole provided in the other of said power source and said closure member and capable of guiding said pin in the axial direction of said pin.

10. A closure device according to claim 8, wherein said relative movement means includes a rail secured to either one of said power source and said closure member and a slider secured to the other of said power source and said closure member and movable in the longitudinal direction of said rail, said slider being slightly movable in the direction perpendicular to the longitudinal axis of said rail.

11. A closure device according to claim 8, further comprising relative rotation means provided between said power source and said closure member and capable of allowing a relative rotation between said power source and said closure member within the plane of the relative movement allowed by one of said relative movement means.

12. A closure deice for moving a window glass between open and close positions along a guide provided on a vehicle, comprising:

(a) a rack fixed to said vehicle;
(b) a pinion meshing with said rack;
(c) a motor for driving said pinion to move together with said pinion along said rack; and
(d) supporting means for supporting said motor and said window glass for relative movement therebetween in a direction crossing the direction of movement of sad window glass between said open and close positions;

whereby the movement of said motor along said rack is transmitted to said window glass so as to move said window glass between said open and close positions, while absorbing any offset between said window glass and said motor in the breadthwise direction of said window glass crossing the direction of movement of said window glass between said open and close positions.

13. A closure device according to claim 12, wherein said supporting means includes a guide member connected to said motor and having a longitudinal axis extending in a direction crossing the direction of movement of said glass window between said open and close positions, and a moving member connected to said window glass and movable along the length of said guide member.

14. A closure device according to claim 13, wherein said moving member is slightly movable also in a direction which is orthogonal to the longitudinal axis of said guide member.

15. A closure device according to claim 12, further comprising means for absorbing an offset between said motor and said window glass in the direction of thickness of said window glass.

16. A closure device according to claim 12, wherein the path ofmmovement of said window glass is curved in a plane perpendicular to the direction of breadth of said window glass and said rack is curved along its length in a manner corresponding to the curvature of said path of movement of said window glass, said pinion and said window glass being rotatable relative to each other in said plane perpendicular to the breadthwise direction of said window glass so as to absorb an offset between the path of movement of said window glass and the path of movement of said motor.

17. A closure device for moving a window glass between open and close positions along a guide provided on a vehicle, comprising:

(a) a flexible elongated member connected at both its ends to said vehicle in a tension state;
(b) a rotary member for imparting a driving force to an intermediate portion of said elongated member to urge said elongated member in the longitudinal direction thereof;
(c) a motor for driving said rotary member so as to be thrust together with said window glass along the length of said elongated member; and
(d) supporting means for supporting said motor and said window glass for relative movement in a direction crossing the direction of movement of said window glass between said open and close positions, whereby the thrust for thrusting said motor along said elongated member is transmitted to said window glass so as to cause the movement of said window glass between said open and close positions while absorbing any offset between said window glass and said motor in the breadthwise direction of said window glass crossing the direction of movement of said window glass between said open and close positions.

18. A closure device according to claim 17, wherein said rotary member is a drum around which an intermediate portion of said elongated member is wound spirally.

19. A closure device according to claim 17, wherein said supporting means includes a guide member connected to said motor and having a longitudinal axis extending in a direction crossing the direction of movement of said closure member between said open and close positions, and a moving member connected to said window glass and movable along the length of said guide member.

20. A closure device according to claim 17, further comprising means for absorbing any offset between said motor and said window glass in the direction of thickness of said window glass.

* * * * *